United States Patent [19]

Close

[11] Patent Number: 4,477,924

[45] Date of Patent: Oct. 16, 1984

[54] AM STEREO DETECTOR

[75] Inventor: Ernest F. Close, Fort Wayne, Ind.

[73] Assignee: Magnavox Consumer Electronics Company, New York, N.Y.

[21] Appl. No.: 335,090

[22] Filed: Dec. 28, 1981

[51] Int. Cl.[3] ..... H04H 5/00

[52] U.S. Cl. ..... 381/15; 381/16

[58] Field of Search ..... 179/1 GS; 381/15, 16

[56] References Cited

U.S. PATENT DOCUMENTS

| | | | |
|---|---|---|---|
| 4,362,999 | 12/1982 | Sauer | 179/1 GS |
| 4,370,520 | 1/1983 | Malchow | 179/1 GS |
| 4,379,208 | 4/1983 | Isbell et al. | 179/1 GS |

*Primary Examiner*—R. J. Hickey

*Attorney, Agent, or Firm*—Pitts, Ruderman & Kesterson

[57] ABSTRACT

The method and apparatus for providing an AM stereo receiver suitable for receiving an AM/PM modulated RF carrier frequency, the receiver uses a standard AM detector to receive said AM/PM modulated intermediate frequency and to provide an 1+r signal. The stereo detector system further provides an 1−r signal and comprises means (104) for receiving and limiting the amplitude of the AM/PM modulated signal to eliminate the amplitude modulation therefrom and for providing a signal having phase modulation only. The limited AM/PM signal from limiter (104) is then provided to an FM quadrature detector (106) for recovering any PM signal. The PM signal detected and provided by said FM quadrature detector (106) is then integrated by an integrator (124) to provide a true PM signal. The output of integrator (124) is provided to a squelch gate (128) and to a means for sampling and determining the presence of a 5 Hz signal. The means for sampling and determining comprises a 5 hz band pass filter (130), a squaring circuit (132) and a missing pulse detector (134). The squelch gate (128) receives a control signal from missing pulse detector (134) along with the 1−r signal from integrator (124). The 1−r signal then passes through squelch gate (128) in response to the presence of the control signal which indicates a stereo broadcast. The output from squelch gate (128) which is the 1−r signal is then combined with the 1+r signal from the standard AM detector by a matrix (102) to provide a true L and a true R signal for a stereo AM broadcast.

4 Claims, 4 Drawing Figures

AM STEREO DETECTOR

TECHNICAL FIELD

This invention relates generally to stereo receiving systems and more particularly to an AM/PM stereo system operating on the standard AM broadcast band. This system provides a new technique for decoding or stripping the PM signal from the IF. The simple and inexpensive system also includes a technique for readily detecting the presence of a 5 Hz subaudible tone signal.

BACKGROUND ART

AM broadcast bands have, of course, been used for a long time in the radio field and did in fact dominate modern radio broadcasting for many years. Since the advent of AM broadcasting, however, FM radio broadcasting has become more and more in demand because of the concurrent development of FM stereo broadcasting systems. Until recently, there has been little or no effort involved in developing AM stereo systems. However, experience has shown that even though FM systems have some advantages as far as static reduction and the like, they also have difficulties in that the "line of sight" requirements severely limit the transmission distance that can be achieved by FM broadcasts. This is especially true in mountainous or hilly regions. Consequently, recent efforts have resulted in the development of various types of AM stereo broadcasting systems which operate on the standard AM broadcast band. In particular, there is now available an AM/PM stereo system which uses the standard AM broadcast band and also operates satisfactorily with existing AM transmitting systems with substantially no modifications required. Thus, this AM/PM stereo system holds great promise for future AM stereo broadcast and will especially be effective if the receiving system can be kept at a reasonable consumer price. Of course, to be completely accepted as an alternate to present FM stereo broadcast systems, it is believed that any AM substitute system will necessarily need to operate substantially similarly, so far as the consumer or listener is concerned, to the presently available FM stereo systems. Thus, as is the case with FM stereo broadcasting, there should also be available on an AM stereo receiving system the stereophonic broadcast indicator light to indicate the station is in fact broadcasting in stereo. Further, as was indicated hereinabove it is extremely desirable, considering the vast number of AM transmitters now in service, that these existing transmitting systems be capable of incorporating AM stereo without extensive modifications. It will also be appreciated that a simple and inexpensive technique for providing an AM stereo receiver may be necessary for consumer acceptance.

Therefore, it is an object of the present invention to provide a simple and inexpensive technique for decoding and providing stereo signals from AM/PM transmitted signals on a standard AM broadcast band.

It is still another object of this invention to provide both methods and apparatus to monitor and detect the existence of an AM stereo broadcast and provide a visual indication of such a broadcast.

It is yet another object of the present invention to provide methods and apparatus which do not require the expensive phase lock loop techniques of recovering PM phase modulated signal from a carrier frequency.

DISCLOSURE OF THE INVENTION

Other objects and advantages will in part be obvious, and will in part appear hereinafter, and will be accomplished by the present invention which provides apparatus and methods for decoding and determining the presence of a PM (phased modulated) signal on the intermediate frequency of a standard AM receiver. The apparatus of this invention comprises a decoder which is suitable for use in an AM stereo receiver which receives AM/PM modulated signals along with a 5 Hz subaudible tone which is further modulated on the RF carrier as an FM signal. The decoder of this invention includes a standard AM detector for recovering the AM (amplitude modulated) portion from the intermediate frequency of the AM broadcast to provide a mono or l+r (left plus right) signal. The decoder also receives the phase modulated intermediate frequency and provides an l−r (left minus right) signal. The PM decoding apparatus includes a means for first receiving and limiting the amplitude of the AM/PM signal to eliminate or strip any amplitude modulation therefrom and provide a signal containing only the PM (phase modulation). The PM signal is received by an FM (frequency modulated) quadrature detector which, because of the similarity of PM signals and FM signals, is able to detect the presence of the PM signal and recover a signal therefrom. To obtain the required PM signal from the signal recovered by using the FM quadrature detector, the recovered signal is received by a means for integrating, which can be either a passive system or active system. As will be appreciated, integrating the PM signal recovered by using the FM quadrature detector produces a correct PM (phase modulated) signal, such that the required PM signal is obtained at the output of the integrator. Also included is a means for sampling the output of the integrator and for detecting the presence of a 5 Hz FM signal which is included therewith and is indicative of a stereo broadcast. In addition to being sampled by the 5 Hz detector, the PM signal (which provides the l−r signal) is provided to a squelch gate along with a control signal operated by the 5 Hz detector such that the l−r signal is passed through the squelch gate in response to the control signal indicating that a stereo broadcast is present. The l−r signal is then vectorially combined with the l+r signal to provide two l signals or an L signal and two r signal or an R signal which, of course, are representative of the two channels (left and right) in an AM stereo broadcast.

BRIEF DESCRIPTION OF THE DRAWINGS

The above-mentioned features of the present invention will be more clearly understood from the consideration of the following description in connection with the accompanying drawings in which.

BEST MODE FOR CARRYING OUT THE INVENTION

At the present time, it appears that the AM/PM system technique will be used for future AM stereo broadcasting systems. This system allows the continued use of existing AM transmission or broadcasting systems by simply adding new equipment. That is, there is virtually no modification of the existing transmission system required. To provide stereo sound, there must, of course, be a L (left) and a R (right) signal. In the AM/PM tranmission system as is true with any stereo system, these signals may carry different sounds and are combined and transmitted over the AM broadcast frequency band as l+r and l−r signals. The l+r signal is carried on the carrier frequency by amplitude modulation and the l−r is carried on the carrier frequency by phase modulation. These l+r and l−r signals are then processed by the AM stereo receiver where they are finally vectorially added and subtracted to obtain the L and R signals necessary for stereo sound.

Figure 1:
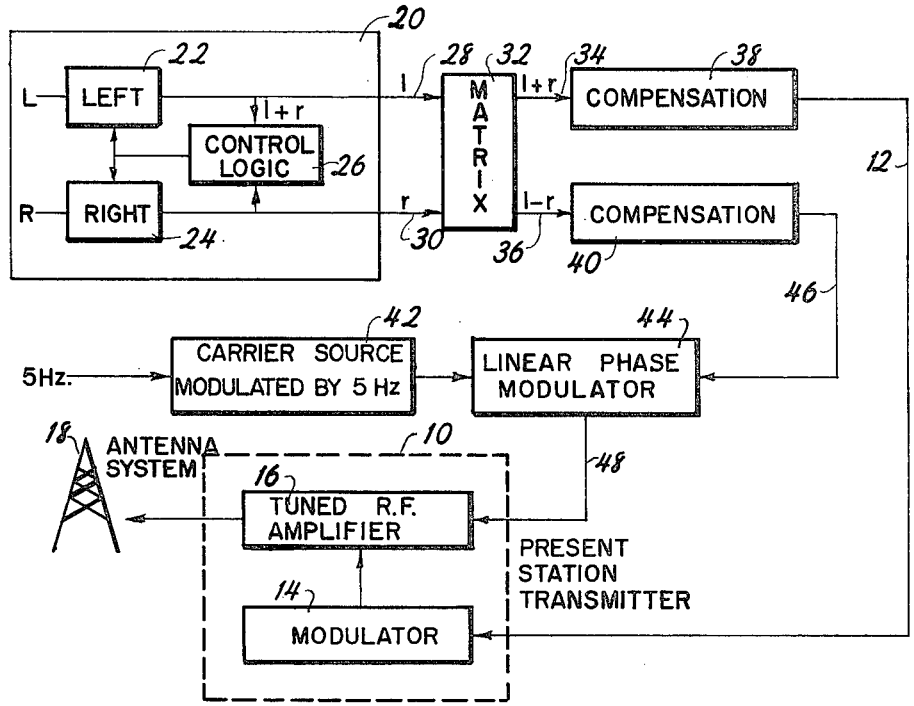
FIG. 1 is a block diagram of an AM/PM stereo broadcasting system which broadcast signals suitable for use and detection by the present invention.

Referring now to FIG. 1, there is shown a block diagram of an AM/PM stereo system which broadcasts over the standard AM frequency band. As shown, there may well be an existing station transmission system 10 which receives a modulating signal on input line 12 which provides the modulating signal to an amplitude modulator 14. The output of amplitude modulator 14 is then provided to an RF section such as a "Tuned RF Amplifier" 16 prior to being transmitted by the antenna system 18. It will be appreciated by those skilled in the art that components 14, 16, and 18 represent standard equipment used by presently available mono AM transmission systems. However, for purposes of stereo AM, this existing system may easily be modified. According to the AM/PM stereo technique, rather than an AM signal carrying only monophonic information which is transmitted by antenna system 18, there is, of course, the need for an L (left) channel and a R (right) channel of music or sound to be included. To obtain the L and R channel information, there is an audio processor 20 which includes a left processor 22 and a right processor 24. There will also typically be included some sort of control logic 26 for assuring that the proper amount of L channel and R channel are available. The L and R signals or channels are then passed on lines 28 and 30 to suitable matrix circuitry 32 which both vectorially adds and subtracts the signals to obtain an l+r (left plus right) signal output on line 34 and an l−r (left minus right) output signal on line 36. Also typically included will be some audio compensating networks 38 and 40 for each of the L and R channels for purposes of equalizing transit time and amplitude of the l+r and l−r signals to preserve the stereophonic separation. The output from circuitry 38 is on line 12 and it will be recalled from the above discussion that in the standard monophonic AM transmission system, the input on line 12 to the modulator 14 was the standard monophonic modulating signal or information. However, in the AM stereo system, the l+r signal becomes the amplitude modulating signal or information input on line 12. In a typical standard AM monophonic tranmission, the carrier source generator 42 typically would simply provide the carrier frequency to the RF section 16 for use as the transmission carrier. However, in the AM/PM stereo system, the carrier frequency in addition to being generated at a highly stable particular frequency, is frequency modulated (FM) with a 5 Hz subaudible tone. This 5 Hz frequency modulated carrier frequency is then used as a reference for a linear phase modulator 44. Then as shown, the reference signal is phase modulated by the l−r signal on line 46 received from audio compensating network 40. Thus, it will be appreciated that the l−r output signal on line 46 will result in a true PM (phase modulated) signal imposed on the carrier frequency. That is, the carrier frequency which has been phase modulated by the l−r audio signal is available at the output of linear phase modulator 44. The output of linear phase modulator 44 on line 48 is then passed to the RF section 16 of the station transmittor 10. This phase modulated carrier signal is then amplififed and AM (amplitude modulated) by the l+r audio signal discussed heretofore prior to being put into the antenna system 18 for transmission on the standard AM frequency radio band. Thus, it will be appreciated that according to the AM/PM stereo system, the antenna system 18 will transmit an AM/PM carrier frequency over the standard AM broadcast band, while also carrying an FM 5 Hz subaudible tone. The transmission from the antenna system operates in the same manner as the standard AM monophonic transmission.

Figure 2:
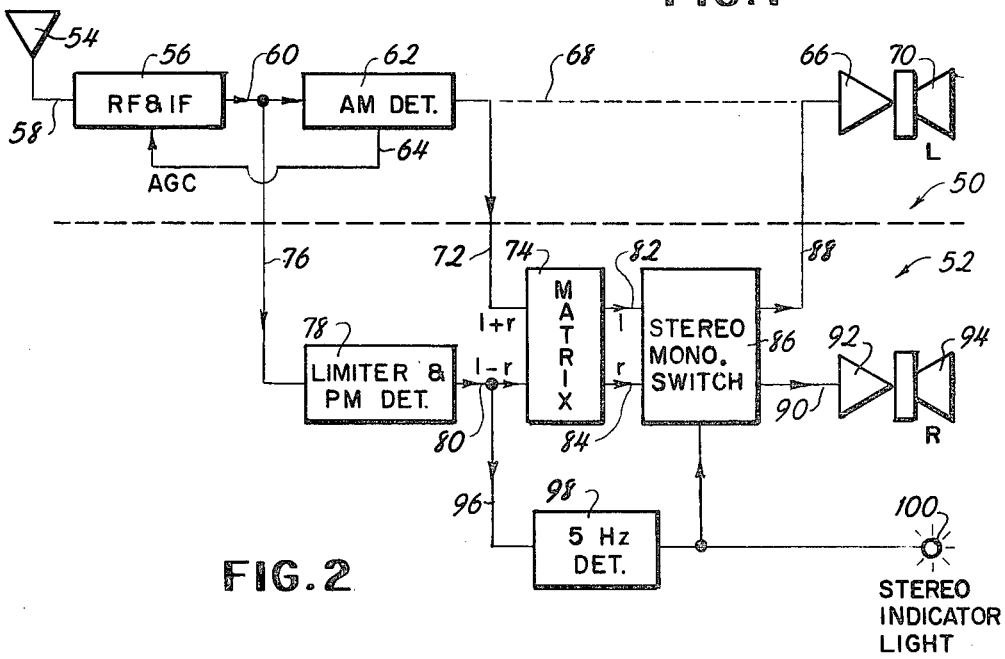
FIG. 2 discloses a block diagram of a typical AM/PM stereo receiver suitable for receiving AM/PM modulated signals present on the standard AM broadcast band.

Referring now to FIG. 2, there is shown a simple block diagram of a receiver system suitable for receiving the AM/PM carrier frequency, detecting the AM (amplitude modulation) and the PM (phase modulation) imposed on the carrier frequency, and providing stereophonic left and right sounds. As shown, the block diagram of FIG. 2 is divided into section 50 which represents a typical standard or presently existing AM receiver. Section 52 represents those components necessary to be added to provide the stereophonic sound. As shown, the RF signal will be received by an RF antenna 54 which provides the RF signal to standard, typical, and presently existing RF and IF amplifiers 56. However, it will be appreciated that the signal on line 58 from antenna 54 to RF and IF amplifiers 56 rather than being an AM (amplitude modulated) carrier signal only, will be an amplitude and phase modulated carrier signal. According to existing AM monophonic systems, the output of the amplifiers 56 is provided by a line 60 to a standard AM detector 62. It will be appreciated that AM detector 62 may be any presently existing standard AM type detector which is capable of detecting or stripping the amplitude modulation from an IF signal. Also shown and as is typical in many types of monophonic AM receivers, there would typically be a feed back automatic gain control (AGC) loop indicated by line 64. In the standard monophonic AM receiver, the output from the AM detector 62 would typically be applied directly to audio amplifier 66 as is indicated by dashed connecting line 68. Audio amplifier 66 would then in the normal monophonic AM receiver apply its audio output signal to a speaker 70. However, in the case of a stereo AM receiver, the output of the AM detector 62 rather than being applied directly to an audio amplifier 66 is applied by line 72 to a matrix 74 which will be discussed hereinafter. It will also be appreciated that from the discussion of FIG. 1 in the transmission system, the amplitude modulating signal for AM stereo broadcast is the l+r signal rather than a standard mono modulating signal. Thus, the signal applied to matrix 74 is the combined l+r signal. In addition, the amplitude modulated, phase modulated intermediate frequency output from the IF amplifer 56 is sampled in the stereo AM receiver by means of line 76 which applies this AM/PM IF signal to a limiter and phase modulation detector 78. It will be appreciated that the sampled signal on line 76 includes amplitude modulation and therefore to eliminate any of the amplitude modulation, the limiter in the limiting and phase modulated detector 78 is an amplitude limiter which cuts off the top and bottom peaks of the modulated signal such that there is no longer any amplitude modulation. The limited signal is then passed into circuitry for stripping the phase modulation portions therefrom. It will be appreciated that the phase modulated signal carries an l−r signal. As shown, the l−r signal is passed by means of line 80 to matrix 74. Matrix 74 then vectorially adds the l+r signal discussed heretofore, and the l−r signal to obtain a 2 l, or an L signal output as indicated on line 82. It will be appreciated that by vectorially adding the l+r and the l−r signals, the r's cancel each other leaving a 2l or an L signal. In a similar manner, the matrix 74 vectorially subtracts the l+r and the l−r signals to obtain a 2r, or an R signal on line 84. In vectorially substracting the l+r and the l−r signals, of course, the l's cancel each other leaving a 2r or R signal. The L signal and R signal on lines 82 and 84 are then passed through stereo mono/switch 86 prior to being distributed to audio amplifiers and speakers. As shown, the output from stereo/mono switch 86 includes line 88 carrying the left channel to audio amplitude 66 and subsequently to speaker 70. In a similar manner, the output on line 90 carries the right channel to an audio amplifier 92 and a right speaker 94. Thus, it can be seen that there has been described a system for obtaining a left and right stereophonic signal from an AM/PM carrier frequency. However, the standard circuit usually includes a few other components which are necessary for satisfactory AM stereo reception and customer acceptance. As shown, the l−r signal on line 80 is sampled by line 96 and this sample signal is applied to a 5 Hz detector 98. Since the 5 Hz subaudible tone is frequency modulated onto the carrier frequency only when the transmission station is transmitting in stereo, a determination that a 5 Hz signal is present indicates that the station is transmitting in stereo. Thus, the output of detector 98 may be used to energize a stereo indicator light 100 to indicate to the user that the station is transmitting in stereo. The output of detector 98, however, is also typically provided to the stereo mono switch 86 such that at any time the l−r signals drop out, or the transmitted signal is no longer in stereo, the stereo indication signal will control the mono switch 86 such that only the l+r signal, which in the case of a monophonic transmission is simply the normal monophonic sound, will be provided to the audio amplifiers 66 and 92, and the speakers 70 and 94. Thus, there has been disclosed and described a typical system for receiving an AM/PM stereo broadcast carrier frequency, stripping the l+r and l−r signals from the carrier frequency, and combining these signals to obtain true L (left) and R (right) channel stereo signals which are then amplified and provided as stereo sound.

Figure 3:
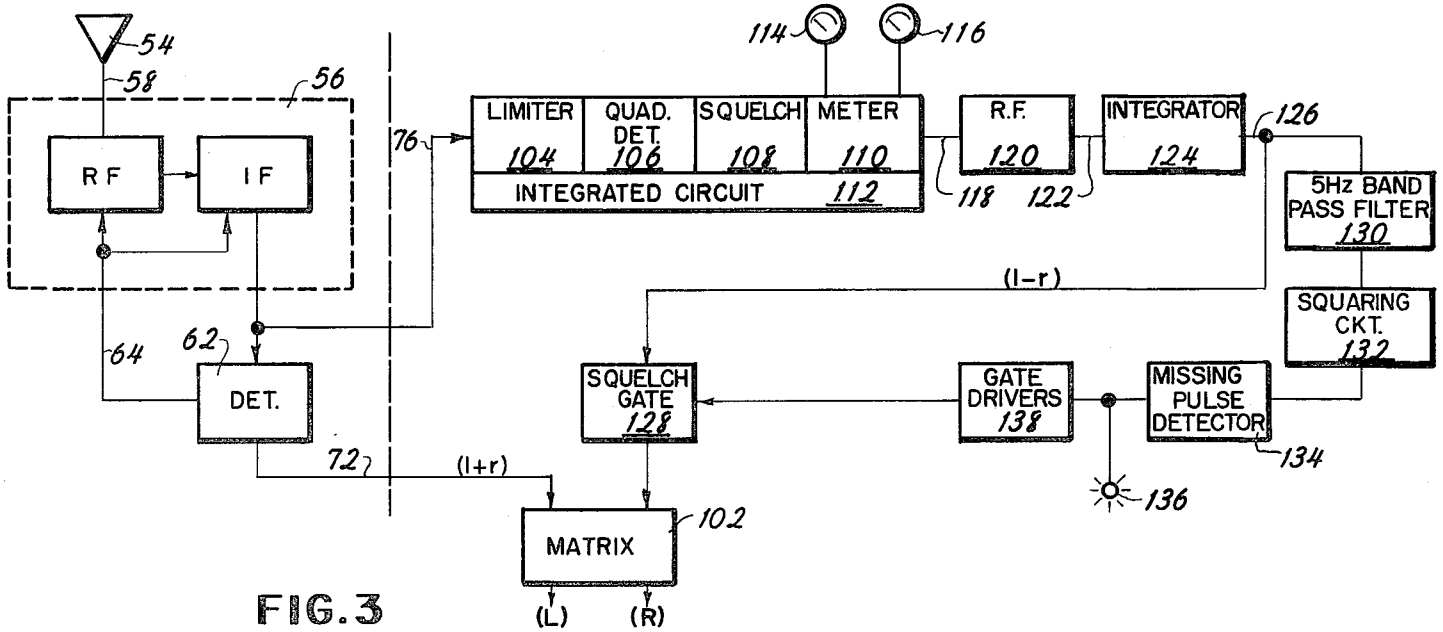
FIG. 3 is a block diagram disclosing the PM decoding technique of the present invention in combination with the standard AM/PM stereo system.

Referring now to FIG. 3, there is disclosed a block diagram of circuitry of this invention which accomplishes the necessary tasks for an AM/PM stereo receiver as was discussed heretofore in a more efficient and inexpensive manner. As shown in FIG. 3, the l+r signal received on line 72 as was discussed above, is also provided to a matrix which in this figure is labeled 102. This is accomplished in exactly the same manner as was discussed hereinabove. Also as was discussed hereinabove with respect to FIG. 2, limiter and phase modulation detector 78 receives the l−r modulated IF signal on line 76 such that the l−r audio signal may be detected or stripped therefrom. In the circuitry of this invention, the l−r signal is also passed through amplitude limiting circuitry 104. For purposes of this invention, amplitude limiter 104 is preferably highly symmetrical such that both the bottom and top portion of the carrier envelope are symmetrically limited. Further, the output of the amplitude limiter 104 is provided to a standard FM (frequency modulated) quadrature detector 106. It will be appreciated, of course, that in the discussion above with respect to FIG. 2, the typical and most common technique for stripping the phase modulated audio signal from the intermediate frequency was by means of phase-lock-loop circuitry. However, according to the present invention rather than removing the PM (phase modulation) directly therefrom, a standard FM quadrature detector is used which strips the phase modulated signal from the intermediate frequency as though it was a frequency modulated (FM) signal. There is also shown a squelch detector 108 and meter drivers or signal drivers 110 as portions of the overall circuit referred to as circuit 112. It will be appreciated that although each of the circuits 104, 106, 108, and 110 operate as independent circuits, they are shown together in this embodiment since there is a suitable integrated chip to be discussed later which can effectively provide all four functions. The information stripped from the limited intermediate frequency by the FM quadrature detector 106 is then provided to the signal squelch circuitry for purposes of completely squelching the signal when the strength of the phase modulated signal becomes too low. This is especially useful for preventing noise when the AM modulation is 100%. Without this circuitry, whenever 100% modulation is achieved a burst of noise would be transmitted through the system. In addition, the signal is sampled by the meter drive circuitry 110 for purposes of providing output signals for zero centering the frequency as indicated by meter 114 and determine the signal strength as indicated by meter 116. Thus, the PM signal in FM form stripped from the carrier is provided from circuit 112 by means of line 118 to an RF noise filter 120 which is used to remove any remaining RF noise which may have found its way through circuitry 112. The RF noise filter 120 may of course constitute any suitable RF filter. The output of the RF filter therefore constitutes the PM signal as obtained from the FM quadrature detector 106. This signal is then provided by line 122 to an integrator 124. It is important to understand at this point that a PM signal processed by a FM quadrature detector which is then integrated by any suitable means will be effectively converted to a true PM or phase modulated signal, since the combination of a FM detector followed by an integrator constitutes a practical and theoretically correct PM demodulator. It will further be appreciated that according to the circuitry of this invention integrator 124 may be a passive integrator or any other suitable active integrator which may be available. Thus, of particular importance with respect to the circuitry of this invention, it should be appreciated that a standard FM quadrature detector which is readily available on the market may be used to provide a partially recovered PM signal which is then simply integrated to obtain a true PM (phase modulated), signal on line 126 representing the l−r audio signal. The output on line 126 is then provided according to this particular circuitry to a squelch gate 128 (which may take the form of a diode-bridge) prior to being applied to matrix 102. Thus, as will be discussed hereinafter, squelch gate 128 will operate as the stereo/mono switch 86, and in fact operates to achieve the same function. In addition to the output to squelch gate 128, the l−r signal is sampled by a 5 Hz filter 130 (preferably an active filter) which will pass any 5 Hz subaudible tone present thereon. It will, of course, be appreciated that the quadrature FM detector discussed heretofore will have detected or removed the FM modulated 5 Hz subaudible tone at the same time it detected the phase modulated PM signal in frequency modulated FM form. However, of couse, it will further be appreciated by those skilled in the art, that even though the integrator 125 may have altered the 5 Hz FM signal from a true FM signal, the 5 Hz active filter 130 can still effectively operate on the stripped 5 Hz signal. Thus, the 5 Hz signal stripped from the l−r audio signal is passed to a processing circuit such as for example a squaring circuit 132. A square wave 5 Hz signal is then provided to a pulse detector 134 which is used for determining the presence or absence of the 5 Hz signal. If the 5 Hz signal is present, this detector will provide means for lighting the stereo light 136 and also provide a signal to drive gate 138 which in turn controls squelch gate 128 discussed heretofore. However, in the event the 5 Hz signal is not present, the stereo light will not be illuminated, and the control signal from gate drive 138 to squelch gate 128 will prevent the l−r audio signal from passing squelch gate 128 and being fed to matrix 102. Of course, the absence of the 5 hz subaudible tone indicates that there is no stereo broadcast and consequently no information on the l−r signal. Thus, by preventing the passage of the l−r signal through squelch gate 128 when no information is carried thereon, the noise which might otherwise be provided and combined with the l+r signal at matrix 102 is readily eliminated. Thus, there has been described to this point, unique circuitry which uses readily available FM quad detectors to obtain an information signal which is then integrated to obtain a true and proper PM signal and which is especially useful in providing an inexpensive and effective AM stereo receiving system.

Figure 4:
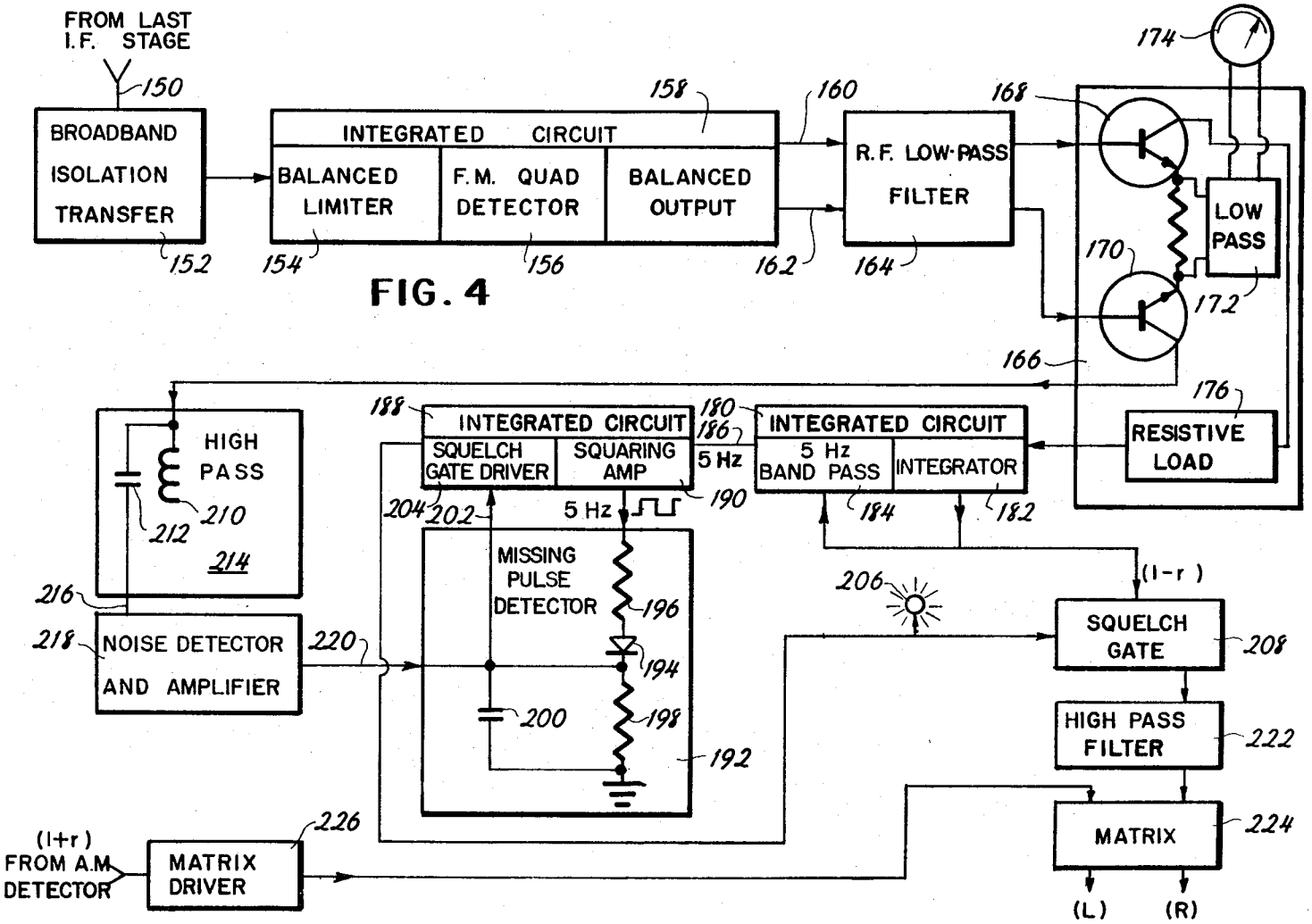
FIG. 4 is a schematic diagram of the AM/PM decoding system of the block diagram of FIG. 3.

Referring now to FIG. 4, there is shown a schematic diagram suitable for achieving the purposes and intent of the circuitry described in FIG. 3 above. The schematic diagram of FIG. 4 is a specific embodiment of the block diagram of FIG. 3 and utilizes specific integrated chips which have been found especially useful in the present invention.

According to this embodiment, the AM/PM signal from the last IF stage of a receiving unit is provided on line 150 to a broadband isolation transformer 152. The output of the isolation transformer is then provided to a symmetrical limiter 154 for stripping the amplitude modulation portion therefrom. As shown, the symmetrical limiter 154, and a quadrature detector 156 as discussed heretofore are all included on an integrated chip such as integrated circuit Chip TCA 420A available from U.S. Philips Corporation. The operation of these circuits is the same as was discussed heretofore with respect to FIG. 3. A balanced output of the quadrature detector 156 from the integrated chip 158, on lines 160 and 162 is, as before, then provided to an RF low pass filter 164. This filter is a simple passive RC-RF filter for purposes of removing any remaining RF noise and the like. The output of the RF filter 164 is then provided to a compound amplifier 166 using a pair of general purpose transistors 168 and 170 (such as Magnavox type 94N4) which are loaded in both the emitter and collector circuits. The balanced outputs from the emitters of these transistors are then preferably passed through a low pass filter 172 to eliminate the 5 Hz signal. The filtered signal is then used to drive zero-center tuning meter 174. The collector of transistor 168 has a simple resistive load 176 for substantially flat frequency response from a low value of 5 Hz to above 20 Kilohertz. The output from resistive load 176 on line 178 may then be provided to an operational amplifier. According to the present embodiment, the output on line 178 is provided to one-half of a dual operational amplifier integrated circuit 180 such as Magnavox type 612143-1 which is connected as an "approximate" integrator 182. It is preferable not to use a true integrator in this application because of DC overload and drift problems. Further, a true integrator would result in excessive gain at 5 Hz. As actually used, the operational amplifier and its associated components are connected as an integrator to provide a frequency response that is substantially flat below about 20 Hz but which falls off at 6 db per octive above this point in the same manner as a true integrator. The remaining half of the dual operational amplifier 180 is connected as a 5 Hz active band pass filter 184 to recover the 5 Hz stero indicator tone.

To quickly and positively identify the presence of the 5 Hz tone, the output of filter 184 is provided on line 186 to dual integrated circuit 188 which may also be a Magnavox type 612143-1. Operational amplifier 188 performs several interrelated functions resulting in fast and accurate stero switching with good noise immunity and substantial freedom from false triggering. The first section of circuit 188 operates as a squaring amplifier 190 by being connected as an overdriven amplifier with a small amount of positive feedback to give substantially a 5 Hz square wave output. This 5 Hz square wave output in turn operates a simple missing-pulse detector 192. Missing-pulse detector 192 consists of a diode 194 which drives a dual time constant circuit which includes resistors 196 and 198, and capacitor 200. Capacitor 200 charges quickly on the rising edge of a 5 Hz squarewave, and discharges at a lower rate. As long as 5 Hz waves continue into the circuit without interruption, such as occurs during the reception of an AM stereo broadcast, the output on line 202 of the circuit remains above a selected level, and the second section of circuit 188 which operates as a "squelch gate driver" circuit 204 is held in the "on" position. The squelch gate driver circuit 204 in turn provides power to the stereo indicator light 206 and to squelch gate 208 to allow the l−r signal to pass. If one or more 5 Hz cycles is missing, capacitor 200 discharges below the selected threshold level and the stereo indicator light 206 and squelch gate 208 are both turned off. This circuit, although simple, works substantially faster than other available methods such as a phase-lock-loop tone detector, or a simple 5 Hz amplitude detector, and allows the advantage of quick identification of an AM stereo signal so that the user finds the receiver easy to tune.

The collector of transistor 170 of compound amplifier 166 is connected and loaded with an inductor 210 and capacitor 212 which act as a high pass filter 214 to substantially attenuate frequencies below about 25 kilohertz. During normal reception of either a monophonic or sterophonic signal, there, of course, is almost no signal present at the output on line 216 since the audio frequency band is below 25 Kilohertz. However, when the receiver is tuned between stations, or there is a short drop out or overmodulation peak, there may be a considerable noise signal present on line 216 which is passed to noise detector and amplifier 218. The output 220 of noise detector 218 is connected to the missing pulse detector 192 and squelch gate driver 204 so as to quickly discharge the missing pulse detector 192 and thereby extinguish the stereo indicator light 206 and close squelch gate 208 even before the missing pulse detector 192 can react in the normal manner. Thus, circuitry is provided which can quickly detect the presence of an AM stereo signal, but which at the same time is prevented from showing a spurious indication on noise pickup between stations. Further, short signal fades or drop-outs cause the squelch circuit 208 to be activated so that the receivers smoothly revert briefly to monophonic operation as noise from the l−r channel is effectively cut off and prevented from reaching the listener. The output of squelch gate diver circuit 204 which drives both the squelch gate 208 and the stereo indicator light 206 may use any suitable technique or circuits such as a diode bridge, analog switch or others. However, it has been found that an FET such as a Magnavox FET transistor type 234F1 is particularly useful.

The output of the squelch circuit 208 which includes the l−r information must then be matrixed with the l+r information received from the AM detector as discussed heretofore. For acurate audio matrixing it is important that frequency and amplitude responses of the l−r and the l+r channel be well matched. To facilitate this match in the present embodiment, high pass filter 222 (which filter is preferably an active filter) is interposed between squelch gate 208 and matrix 224. Filter 222 removes the 5 Hz and any other low frequency signals present, and simultaneously produces the needed phase shift to allow the accurate and desired matrixing. Thus, the l−r signal received from high pass filter 222 and the l+r signal which may first be provided through matrix driver 226 before being received at matrix 224 are combined by matrix circuit 224 in the manner discussed heretofore with respect to FIG. 3.

Thus, it will be appreciated that there has been described unique AM stereo receiving circuitry which is suitable for receiving AM/PM signals to provide stereo information. In particular, the system has described the use of a FM quadrature detector followed by an integrating circuit for purposes of detecting the PM signal by first detecting the PM signal as though it were a FM signal. This signal is then integrated to produce a true PM signal. In addition, there has been discussed missing pulse detectors and an interacting noise detector which allows quick identification of AM broadcasts without spurious lock-in due to noise. Finally, although the present invention has been described with respect to specific apparatus for accomplishing the objects of this invention, it is not intended that such specific references be considered limitations upon the scope of this invention except insofar as is set forth in the following claims.

I claim:

1. In an AM stereo receiver suitable for receiving an AM/PM modulated RF carrier frequency which also includes a 5 Hz subaudible tone which is FM modulated on top of the RF carrier when said RF carrier carries a stereo broadcast and which receiver provides an AM/PM intermediate frequency and includes a standard AM detector which receives said AM/PM modulated intermediate frequency and provides a l+r signal; an AM stereo detector which also receives said AM/PM modulated intermediate frequency and provides an l−r signal, said AM stereo detector comprising:

means for receiving and limiting the amplitude of said AM/PM modulated signal to eliminate said amplitude modulation therefrom and provide a signal having PM (phase modulation) only;

a FM quadrature detector for receiving said PM signal, and recovering PM information in the same manner as FM information from said limited PM signal representative of a l−r signal;

means for integrating said PM signal recovered from said limited signal to obtain a true PM signal;

means for sampling said output from said integrator and determining if a 5 Hz signal is present therewith, and providing a control signal indicative of the presence of said 5 Hz signal on a stereo broadcast, wherein said means for sampling comprises a 5 Hz band pass filter, means for squaring the wave shape of said 5 Hz filtered signal, and a missing pulse detector for providing said control signal when said 5 Hz squared signal occurs at a selected rate;

a squelch gate for receiving said l−r signal from said integrator and for receiving said control signal, and for allowing said l−r signal to pass through said squelch gate in response to said control signal indicating a stereo broadcast; and means for receiving and vectorially combining said l+r signals and said l−r signals to provide a 2l or L signal and a 2r or R signal representative of two channels in a stereo AM broadcast.

2. The stereo receiver of claim 1 wherein said missing pulse detector comprises a diode for receiving said 5 Hz filtered signal, said diode then driving a dual time constant circuit including a capacitor and resistor combination connected such that said capacitor charges on the rising edge of a 5 Hz signal at a first rate and discharges at a second rate slower than said first rate.

3. The stereo receiver of claim 1 and further including an audio high pass filter for receiving a portion of said l−r signal from said quadrature detector for passing signals above about 25 Kilohertz, and a noise detector and amplifier for receiving said passed signals and providing an output to said missing pulse detector to discharge said capacitor such that normal operation of said missing pulse detector is by-passed.

4. The stereo receiver of claim 1 further including means for indicating the presence of a stereo broadcast in response to said control signal.

* * * * *